US005213373A

United States Patent [19]

Ramos

[11] Patent Number: 5,213,373

[45] Date of Patent: May 25, 1993

[54] MARK POSITION INDEPENDENT FORM AND TALLYING METHOD

[76] Inventor: Severino Ramos, Box 554, El Senorial, Rio Piedras, P.R. 00928

[21] Appl. No.: 884,043

[22] Filed: May 14, 1992

Related U.S. Application Data

[63] Continuation of Ser. No. 562,884, Aug. 6, 1990, abandoned.

[51] Int. Cl.[5] ..... B42D 15/00

[52] U.S. Cl. ..... 283/5; 434/363; 235/454

[58] Field of Search ..... 283/5, 91; 434/358, 434/363; 235/50 R, 56, 51, 435, 437, 454

[56] References Cited

U.S. PATENT DOCUMENTS

| | | | |
|---|---|---|---|
| 3,995,381 | 12/1976 | Manfred et al. | 434/363 |
| 4,576,439 | 3/1986 | Gale et al. | 283/91 |
| 4,813,708 | 3/1989 | Narey | 283/5 |
| 4,892,385 | 1/1990 | Webster, Jr. et al. | 283/91 X |

*Primary Examiner*—Mark Rosenbaum
*Assistant Examiner*—Willmon Fridie, Jr.
*Attorney, Agent, or Firm*—Allegretti & Witcoff, Ltd.

[57] ABSTRACT

An electronically scannable form and method for its use, the form comprising at least one marking zone defined by a plurality of mark positions, each mark position defined by a mark position row and mark position column, the form being printed with reflective ink and marked by a respondent with a non-reflective material such that any mark at least partially obliterating at least one mark position in a marking zone will be electronically scanned and identified as correspoding to the choice defined by the marking zone.

6 Claims, 2 Drawing Sheets

MARK POSITION INDEPENDENT FORM AND TALLYING METHOD

This application is a continuation of application Ser. No. 07/562,884, filed Aug. 6, 1990, now abandoned.

BACKGROUND OF THE INVENTION

The present invention concerns a scannable form and a method of using the scannable form to record and summarize responses. The form and method are useful in the efficient tallying of responses such as exam answers, time sheets, questionnaires and ballots. The method is most useful for recording and enabling the tallying of votes during an election.

Electronically scannable ballots are presently in common use. One use for scannable forms is voting ballots. Such ballots utilize a form which typically requires that a mark corresponding to the voter's choice be made in a specific location next to the candidate selected. Problems occur when voters do not fill in the specific location next to the candidate selected but instead, for example, place a symbol "X" in a box with the candidate's name, write-in the candidate's name or make any other response which is not in register with the specific mark location. Such improperly completed ballots may be invalidated or in some jurisdictions typically require expensive hand tallying.

SUMMARY OF THE PRIOR ART

U.S. Pat. No. 3,995,381 describes a multi-choice low visibility answer sheet and a method of objective testing using the low visibility answer sheet. The low visibility answer sheet is printed such that the answer areas are pre-darkened with a light-reflective ink. A marking device is used which imparts a mark in the desired answer space which is less light reflective than the pre-darkened answer areas. Such an answer sheet is useful in eliminating the incidence of cheating during standardized testing.

Various methods for scannably detecting and recording responses on a form are known. Such methods are discussed in the SCANTRON MODEL 8000 OMR-/DATA TERMINAL product information flier and in "An Election Administrators Guide to Computerized Voting Systems" published by ECRI in 1988. The SCANTRON MODEL 8000 is a scanner which is capable of scanning forms used in testing, time reporting, employment questions, medical histories, order entry, sales report, surveys, and the like. The optics of the scanner are very precise and measure the light reflected from a narrow segment of a portion of the form. Such a segment is typically about the width of a single line drawn by a sharp pencil. The SCANTRON MODEL 8000 uses optical sensing technology whereby the device detects light reflected from the scannable form. The scannable form is printed with a reflective ink and the form thereafter marked with a light absorbing material. Therefore, the scanner optically detects segments containing a light absorbing material and identifies those segments as containing a response.

The publication "An Election Administrators Guide To Computerized Voting Systems," discusses various electronic voting systems including punch cards, marksense (scannable forms), and direct recording systems. The publication indicates that one drawback with marksense ballot systems is that the ballots that are improperly marked are not electronically countable. Unscannable ballots typically occur where a voter does not mark the ballot in a proper location.

The scannable form and method of this invention group a plurality of mark positions into a marking zone such that any mark in the marking zone which obliterates at least part of at least one mark position is interpreted to be equivalent to a mark made in the ideal mark position in the marking zone. Therefore, the form of this invention does not require a respondent to respond by obliterating a specifically identified marking position in order that the response be electronically scannable in an accurate fashion.

SUMMARY OF THE INVENTION

The present invention is related to a scannable form and a method of using a scannable form to record responses. The scannable form of this invention is printed with a reflective ink. The form is divided into marking zones with each marking zone defined by a plurlity of mark positions. Each mark position is located at the intersection of a mark position column and a mark position row. While a respondent will likely be invited to obliterate a single ideal mark position located in the marking zone, an alternative response such as an "X", a written word or name, or any other response in the marking zone which obliterates at least part of one of the plurality of mark positions located in the mark zone will be electronically recorded by scanning the form.

An object of this invention is to provide a scannable form which is capable of accepting non-conforming responses which can later be scanned and recorded.

Another object of this invention is to provide a method for using the scannable form of this invention to record and then electronically tally responses.

Accordingly, the present invention is a scannable form comprising at least one marking zone. The marking zone is defined by a plurality of mark positions, with a mark position being located at the intersection of a mark position column and a mark position row. Each mark position row is defined by a timing track. The scannable form is preferably printed with a reflective ink and marked with a non-reflective material.

The present invention also includes a method for using a scannable form to record and thereafter electronically tally the responses. The method comprises providing a scannable form printed with reflective ink to a respondent. The scannable form comprises one or more marking zones defined by a plurality of mark positions. Each mark position is located at the intersection of a mark position column and a mark position row. Each marking zone corresponds to a location on the scannable form that a respondent may place a mark. Next the respondent is provided with a non-reflective marking instrument and allowed to place a mark in one or more marking zones with the marking instrument such that at least one mark position in a marking zone is at least partially obliterated. The form is then scanned and any marking zones containing a mark position that is at least partially obliterated by a non-reflective ink mark is tallied as a response. The scanner must be properly programmed to read all mark positions in a marking zone and transmit the corresponding data to a computer for tallying and storage. The computer can be integrated to the scanner or can be a stand-alone unit.

BRIEF DESCRIPTION OF THE DRAWINGS

There is shown in the attached drawing a presently preferred embodiment of the invention wherein like numbers in the various figures refer to like elements and wherein.

DESCRIPTION OF THE PREFERRED EMBODIMENTS

The present invention pertains to a scannable form and a method of using a scannable form to record responses.

A scannable form is useful in many situations where a respondent's responses to particular questions are desired to be electronically identified and tallied. Scannable forms may be particularly useful as ballots, as test answer sheets, or as survey answer sheets. One limitation suffered by scannable forms is that a response that is not properly located in a precise mark position will not be recognized and tallied by the scanning device. The scannable form and method of using the form of this invention overcomes this drawback by allowing the respondent to respond in any manner desired in a marking zone corresponding to a particular response.

Figure 1:
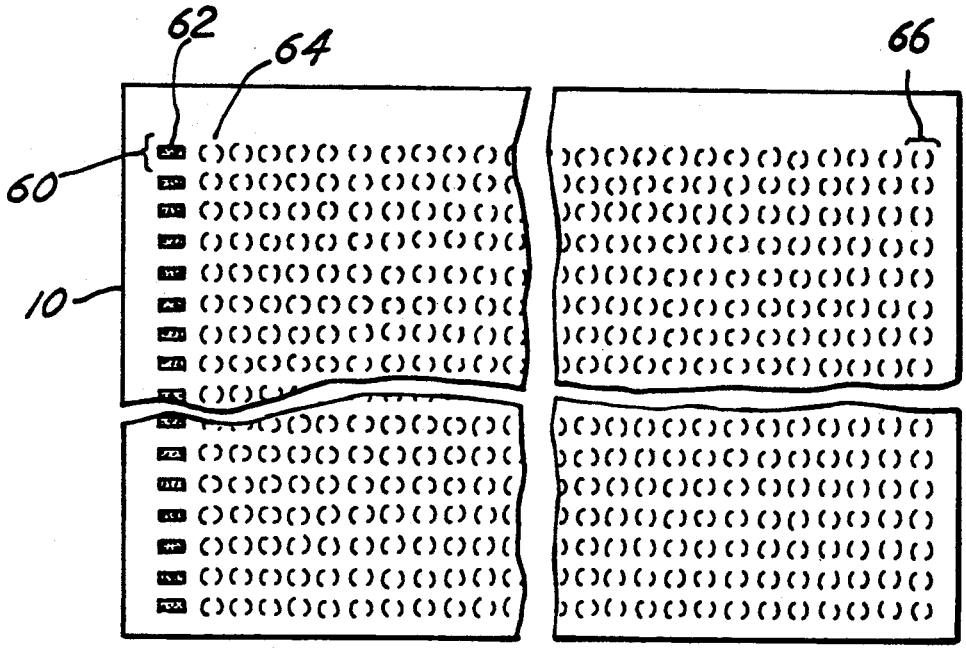
FIG. 1 shows the pattern of mark positions on a scannable form.

With reference to the drawing, FIG. 1 represents the normal pattern of scannable mark positions 64 on a scannable form 10. The scannable form 10 includes mark position columns 66 and mark position rows 60. As seen in FIG. 1, the mark position columns 66 are arranged vertically in side by side relationship. The mark position rows 60 are arranged horizontally on the form 10, one below the other. Each mark position row 60 is defined by a timing mark 62. A scannable mark position 64 is located at the intersection of every mark position row 60 and mark position column 66. Thus, the scannable form consists of a checkerboard of scannable mark positions 64.

Figure 2:
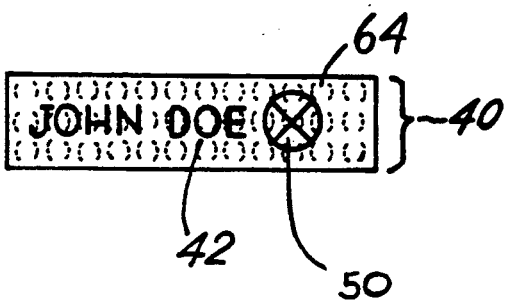
FIG. 2 shows the details of a marking zone.
Figure 3:
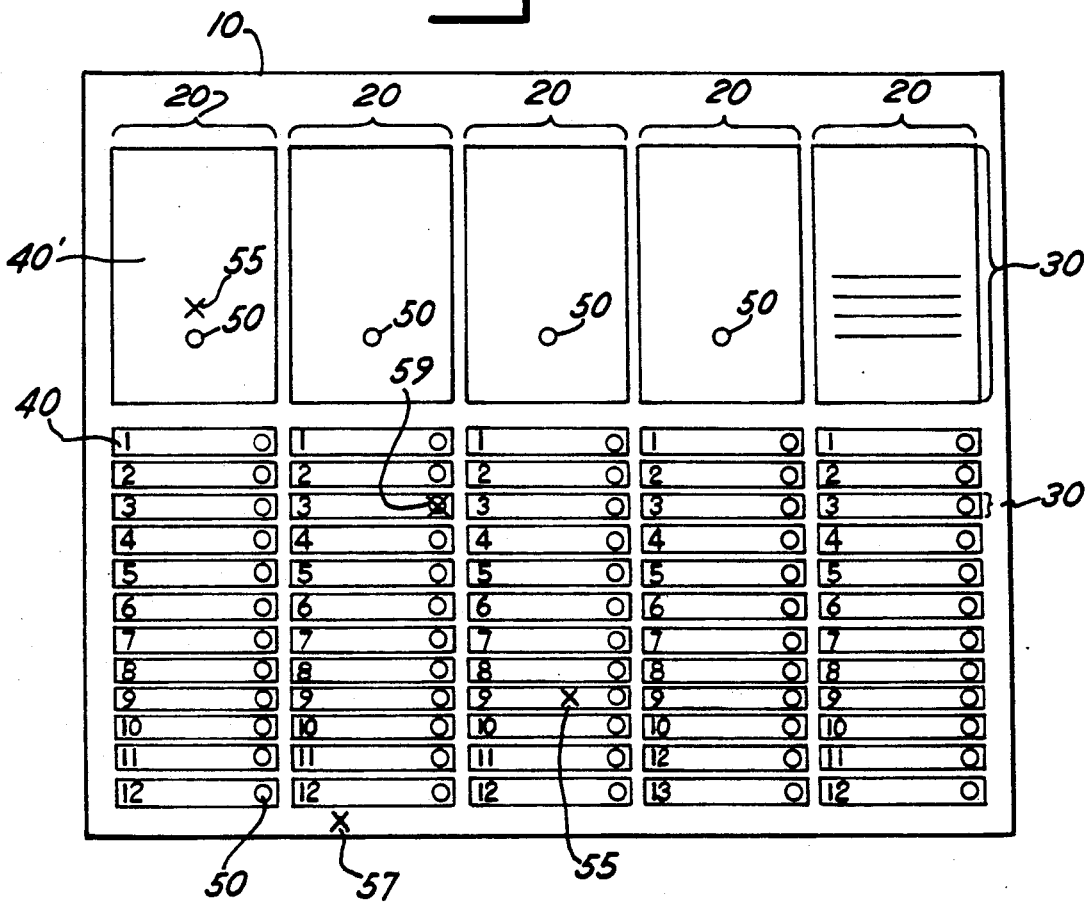
FIG. 3 shows a scannable form of this invention.
Figure 3A:
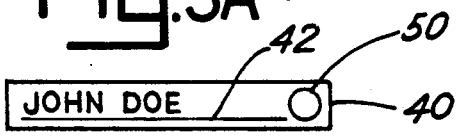
FIG. 3A shows a marking zone of the scannable form of FIG. 3.

FIG. 2 is a detailed depiction of a single marking zone. The marking zone 40 comprises a plurality of scannable mark positions 64. On a typical scannable form, these scannable mark positions 64 would not be visible to the respondent. However, the scanning machine would be programmed to electronically scan each scannable mark position 64 to determine if the mark position has been at least partially obliterated. The marking zone 40 consists of an ideal response location 50 and a response graphic 42 corresponding to the ideal response location 50. FIGS. 3 and 3A show various features of a scannable ballot form of this invention. Scannable form 10 comprises a plurality of marking zone columns 20 and marking zone rows 30. The intersection of the marking zone columns 20 and the marking zone rows 30 define marking zones 40 and 40'. Marking zones 40 and 40' may vary in size. For example, marking zone 40' is a long marking zone, marking zone 40 is short, but both have the same width.

It is preferred that each marking zone 40 and 40', contain an ideal response location 50. The purpose of the ideal response location 50 is to provide an identifiable response location that coincides with a mark position.

A marking zone 40 or 40' may be marked in various ways. The marking zone 40 or 40' may be marked with an ideal response 59 located in the ideal response location 50 of a marking zone 40 or 40'. Alternatively, the marking zone 40 or 40' may be marked with a non-ideal response 55 which is located in the marking zone 40 or 40', but which does not coincide with the ideal response location 50. Finally, the scannable form 10 may be marked with a non-ideal marking zone response 57 which is located outside of any marking zones 40 or 40 prime. A scanner will be incapable of recognizing only the non-ideal marking zone response 57 located outside of a marking zone.

The marking zones 40 or 40' may contain a response graphic 42. The response graphic 42 is typically located adjacent to the ideal response location 50. One purpose of the response graphic 42 is to indicate what a response in the ideal response location 50 corresponds to.

The scannable form of this invention may be used for testing, time reporting, employment questioners, medical history, order entry, sales reports, surveys, as a voting ballot, or for any other application in which one or more responses are elicited from a respondent and are desired to be recorded both physically and electronically. The scannable form is typically a sheet of paper which has been printed with words, symbols or a mixture thereof. The words and symbols direct the respondent to mark the scannable form in a particular manner. The paper which comprises the scannable form can be either opaque or translucent and may be printed on one or both sides. The weight of the paper is not critical.

The purpose of the scannable form is to provide a means whereby a respondents responses can be electronically tallied alone or with other responses. In order to accomplish this goal, the scannable form must conform to a format that is electronically scannable.

A basic scannable form is a rectangular sheet of paper containing a plurality of mark position columns and mark position rows. A mark position row is defined by a timing track. A single mark position is defined by the intersection of a mark position row and a mark position column. Therefore, the number of mark positions on the basic scannable form is the number of mark position columns multiplied by the number of mark position rows.

The understanding of the configuration of the scannable form can be better understood by reference the electronic scanner operation.

In the course of a survey, an election, or some other like procedure, a respondent is requested to select and fill in certain ideal mark positions. These mark positions correspond to specific responses. The scannable form containing the specific responses is fed into an electronic scanner. The scanner such as for example a Scantron model 8000 OMR manufactured by the Scantron Corp., typically operates by searching for and finding a timing mark. Once a timing mark is identified the scanner scans the mark position row searching for mark positions which have been marked by the respondent. When a marked mark position is identified, the scanner records the response and moves on. Once the mark position row is scanned, the scanner searches for the next timing mark and begins to scan the next mark position row. This process is repeated until all of the mark position rows of the scannable form have been scanned by the electronic scanner.

Other scanners that can be used with this invention are those that read text and images directly into the computer. They look and function like a paper copier, producing an electronic digitized copy which is stored in the computer for later retrieval and processing.

A typical electronic scanner is capable of scanning and recording the responses on a multitude of scannable forms in a short period of time. The scanner operates by detecting the presence of a mark in a narrow segment or "window" which is located inside a mark position. The scanner typically operates by projecting light onto the form in the area or areas of the mark positions. A detector picks up any light reflected from the scannable form.

The scanner typically creates an electronic record of each form scanned. The electronic record can be stored in the internal memory of the scanner, directed to a computer electronically united with the scanner, or recorded. The electronic record of the scanning of a plurality of forms is then typically loaded in a computer where the computer analyzes the data and electronically tallies or records the results.

It is preferred that the scannable form of this invention be printed with a reflective ink and be marked with a non-reflective material. By using an reflective ink to print a scannable forms and a non-reflective material to mark the forms, the scanner is able detect a reflected light intensity difference where a mark position has been at least partially obliterated. A scanner detecting light reflected from a reflective marking material is much more sensitive than one which detects a reduction of reflected light. The non-reflective marking material may be applied to the respondent in the form of a pencil or pen containing a non-reflective marking material.

The scannable form of this invention comprises at least one marking zone. A marking zone is defined by a plurality of mark positions. The plurality of mark positions may consist of two or more mark positions in a mark position row, two or more mark positions in a mark position columns, or a combination thereof. Preferably, the marking zone will consist of two or more mark positions in a mark position row and two or more mark positions in a mark position column.

The purpose of the marking zones is to define an area encompassing a plurality of mark positions inside which any response which obliterates at least one mark position will indicate a response in conjunction with the proposition identified by the marking zone.

The scannable form of this invention finally comprises mark positions. As mentioned above, the mark position is the smallest single location which can be marked by a respondent and which will still be detected by the scanner and identified as a response. The locations of the mark positions on the scannable form are discussed above.

The scannable form as described above is useful for recording responses and in many cases totalizing the responses of a plurality respondents. The first step in using the scannable form described above is to provide the respondent with a scannable form printed with a non-reflective ink. The form will typically be separated into identifiable marking zones which can be marked by the respondent. The respondent is provided with a non-reflective marking instrument. The non-reflective marking instrument can be a crayon, a pencil, or a pen containing a non-reflective marking material. It is preferred that the non-reflective marking instrument containing a non-reflective marking material be a pencil or a pen.

The respondent will then be urged to mark the scannable form in the ideal response location located in each marking zone. The respondent may, however, mark the scannable form anywhere in the marking zone with the non-reflective material and still adequately respond as long as at least one mark position is at least partially obliterated by the response. The scannable form is ready for electronic scanning once the respondent has marked the scannable form as he or she sees fit.

The marked scannable form is fed into a scanner preprogrammed to recognize that any mark which at least partially obliterates a mark position in a marked zone is a response that is to be considered identical to an ideal response placed in the ideal mark position in the marking zone. The scanner scans the scannable form and records appropriate responses thereon.

The scannable form allows for the detection of a respondent's response as long as there is some kind of response located in the appropriate marking zone. The response may be an X or a check located outside of the ideal mark position. It may be a word or name written in the marking zone, or it may be any other appropriate response which at least partially obliterates one or more of the mark positions making up the marking zone.

Variations in the scannable form of this invention and in the method for utilizing a scannable form of this invention will become apparent to those skilled in the art. Any such variations as are within the spirit and scope of this invention are intended to be encompassed within the scope of the claims appended hereto.

I claim:

1. An electronically scannable form comprising:

a plurality of mark position rows;

a plurality of mark position columns;

an electronically scannable mark position corresponding to the intersection of each mark position row and each mark position column; and at least one marking zone, each marking zone including;

(i) a plurality of electronically scannable mark positions that are invisible to a respondent;

(ii) an electronically scannable ideal response location visible to the respondent; and (iii) a response graphic.

2. The electronically scannable form of claim 1 wherein the response graphic and ideal response locations are printed with reflective ink.

3. An electronically scannable form printed with reflective ink comprising;

a plurality of mark position rows;

a plurality of mark position columns;

an electronically scannable mark position corresponding to the intersection of each mark position row and each mark position column; and a plurality of bordered marking zones, each bordered marking zone including;

(i) a plurality of electronically scannable mark positions that are invisible to a respondent;

(ii) an electronically scannable ideal response location that is visible to the respondent; and (iii) a response graphic.

4. A method of using an electronically scannable form to record responses comprising the steps of;

providing a scannable form to a respondent having a plurality of mark position rows, a plurality of mark position columns, an electronically scannable mark position corresponding to the intersection of each mark position row and each mark position column and one or more marking zones each marking zone containing a response graphic adjacent to a single electronically scannable ideal response location visible to a respondent, and a plurality of electronically scannable mark positions that are invisible to the respondent;

providing the respondent with a marking instrument capable of imparting a scannable mark on the form;

allowing the respondent to place a mark with the marking instrument in at least one marking zone so that at least one mark position in the marking zone is at least partially obliterated by the mark;

electronically scanning each mark position on the electronically scannable form; and identifying electronically the marking zones with a mark position that is at least partially obliterated by a mark.

5. The method of claim 4 wherein the respondent marks the scannable form with a non-reflective marking instrument.

6. The method of claim 4 wherein the respondent marks more than one marking zone.

* * * * *